US008118369B2

(12) United States Patent
Holl et al.

(10) Patent No.: US 8,118,369 B2
(45) **Date of Patent: *Feb. 21, 2012**

(54) MILLING DRUM FOR A CONSTRUCTION MACHINE, CONSTRUCTION MACHINE AS WELL AS GEARBOX UNIT FOR A MILLING DRUM

(75) Inventors: Bernd Holl, Neustadt/Wied (DE); Stefan Abresch, Elgert (DE); Thomas Lehnert, Oberraden (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/013,016

(22) Filed: Jan. 25, 2011

(65) Prior Publication Data

US 2011/0115278 A1 May 19, 2011

Related U.S. Application Data

(63) Continuation of application No. 11/727,989, filed on Mar. 29, 2007, now Pat. No. 7,901,011.

(30) Foreign Application Priority Data

Mar. 31, 2006 (DE) ..... 10 2006 015 506

(51) Int. Cl.
*E01C 23/88* (2006.01)

(52) U.S. Cl. ..... 299/39.4

(58) Field of Classification Search ..... 299/39.1, 299/39.4, 39.8
See application file for complete search history.

(56) References Cited

U.S. PATENT DOCUMENTS

| | | | | |
|---|---|---|---|---|
| 4,242,020 | A | 12/1980 | Schmid | |
| 4,755,001 | A | 7/1988 | Gilbert | |
| 6,877,818 | B1 | 4/2005 | Gaertner et al. | |
| 7,144,192 | B2 | 12/2006 | Holl et al. | |
| 7,901,011 | B2 * | 3/2011 | Holl et al. | 299/39.4 |

FOREIGN PATENT DOCUMENTS

| | | |
|---|---|---|
| EP | 1194651 B1 | 7/2000 |
| EP | 1520076 B1 | 4/2003 |

* cited by examiner

*Primary Examiner* — John Kreck
(74) *Attorney, Agent, or Firm* — Waddey & Patterson, P.C.; Lucian Wayne Beavers

(57) ABSTRACT

In a milling drum (2) for a construction machine, in particular a road milling machine (1) or a recycler, with an interchangeable milling tube (4) arranged coaxially to the axis (20) of the milling drum, where the milling tube (4) is supported, by means of a support ring (8), on a support ring mount (12) of a rotating body coupled to a milling drum drive (16), it is provided that the support ring (8) and the support ring mount (12) of the rotating body display several complementary supporting surfaces (22, 24) arranged coaxially to the axis (20) of the milling drum, where the said supporting surfaces (22, 24) have different supporting circle diameters and are arranged behind one another axially with their diameters decreasing incrementally in the pulling direction.

23 Claims, 6 Drawing Sheets

MILLING DRUM FOR A CONSTRUCTION MACHINE, CONSTRUCTION MACHINE AS WELL AS GEARBOX UNIT FOR A MILLING DRUM

BACKGROUND OF THE INVENTION

The invention concerns a milling drum and a construction machine, as well as a gearbox unit for a milling drum.

It is often necessary, due to varying job site situations and milling operations, to adapt the milling tool of a road milling machine to the specific tasks at hand. A milling drum with a particular spacing of the cutting tools or a different tooling is required when, for instance, a specific surface texture is to be achieved. In another application, only specific carriageway widths are to be removed, which requires a milling drum with a particular working width.

As a rule, a special milling machine has to be employed in these situations, or else the machine must be equipped with a milling drum adapted to the task at hand. Exchanging the milling drums presently involves a lot of effort, however, and requires special aids for the assembly or disassembly of the milling drum.

Milling drums for road milling machines or recyclers are known from EP 1194651 B and EP 1520076 B where the milling drum displays an interchangeable milling tube with the axis of the said milling tube being supported, by means of a support ring, on a support ring mount of a rotating body coupled to a milling drum drive. The support ring sits on the support ring mount with a predetermined play where dirty water, dust and fine particles of the road surface can penetrate the gap between the support ring and the support ring mount, in particular due to relative movements between the support ring and the support ring mount resulting from the milling operation. The capillary attraction of the clearance fit intensifies this effect, so that dirty water and fine-grained particles penetrate the fit.

When the milling tube with the support ring is to be pulled from the support ring mount for the purpose of disassembly, this is often very difficult or not possible at all.

Disassembly is not easy in view of the given dimensions, namely with a support ring that is short in relation to the diameter of the milling drum when seen in axial direction, even though the assembly in a cleaned state can also prove to be difficult due to tilting.

Supporting surfaces of conical design have also turned out not to be practicable as they can, on the one hand, settle too strongly and, on the other hand, display excessive radial play when the milling drum to be pushed on is too short. A conically designed supporting surface would, therefore, require the conical support ring and support ring mount to be positioned within an accuracy range of +/−1 mm in order to enable a function at all, in which case the problem of a conical connection being prone to seizing will persist nevertheless.

The purpose of the invention is, therefore, to simplify the assembly and disassembly of the milling tube in milling drums with interchangeable milling tubes, in construction machines with milling drums and in gearbox units driving a milling drum.

The characteristics of this application serve to provide a solution to this purpose.

SUMMARY OF THE INVENTION

The invention provides in an advantageous manner that the support ring and the support ring mount of the rotating body display several complementary supporting surfaces arranged concentrically to the axis of the milling drum, where the said supporting surfaces have different supporting circle diameters and are arranged behind one another axially with their diameters decreasing incrementally in the pulling direction.

Due to the staircase-shaped design of the supporting surfaces of the support ring and the support ring mount, the milling tube has to be pulled off in an amount corresponding to the width of one step only to disengage the support ring with the support ring mount, this being achieved without reducing the overall area of the supporting surface. With a fivefold step, for instance, the distance required to separate the supporting surfaces from one another can be reduced to one fifth of the total axial length of the supporting surface.

It is of particular advantage here that the effective supporting surface for the milling tube remains practically the same.

In one preferred embodiment, a minimum number of three, preferably five supporting surfaces are arranged behind one another axially.

The supporting surfaces arranged behind one another axially have a length of 5 to 40 mm, preferably 10 to 20 mm. This creates a stable supporting surface for a milling tube of a milling drum.

The length of a supporting surface may be equal in axial direction. This offers the advantage that, when pulling, all supporting surfaces are disengaged simultaneously.

Alternatively, the supporting surfaces may also have different lengths in axial direction, and preferably in such a manner that the length of the supporting surfaces decreases in accordance with the decreasing supporting circle diameter. This offers the advantage, in particular during assembly, that not all of the supporting surfaces are engaged simultaneously, which may facilitate assembly.

Another preferred embodiment provides that the supporting surfaces of the support ring are offset axially in relation to the supporting surfaces of the support ring mount when seen in the pulling direction of the milling tube, in such a manner that annular chambers are formed at the junctions of the individual steps.

The annular chambers may be used in an advantageous manner to be filled with an anti-corrosive agent or a lubricant.

For this purpose, the annular chambers may be connected with an injection duct that is suitable for the purpose of injecting an anti-corrosive agent and/or lubricant. The injection duct may, for instance, display a nipple for injecting grease.

The supporting surfaces may be coated with a gliding layer to facilitate assembly and disassembly.

The support ring mount may comprise a single-part ring or may also be integral with the rotating body. The single-part support ring mount may, for instance, be pushed onto the rotating body and secured there axially.

Alternatively, the support ring mount may be integral with the rotating body whereby the number of components can be reduced.

An alternative embodiment provides that the support ring mount comprises a multi-part, preferably two-part ring that is suitable for being mounted on the rotating body. Such support ring mount is advantageous when a support ring mount is not capable of being pushed onto the rotating body.

The support ring mount is mounted on the rotating body in an immovable manner axially, forming a floating bearing. The support ring mount can be secured to the rotating body at different positions axially.

An advantageous continuation of the invention provides that the rotating body is a basic drum body for supporting the milling tube and/or an output housing of a gearbox unit of the milling drum drive.

When mounted on two sides, the axis of the milling tube can, on the one hand, be mounted in a removable side wall and, on the other hand, rest upon the support ring mount of the rotating body by means of the support ring, wherein the milling tube can be pulled from the support ring mount of the rotating body in the pulling direction after the side wall has been removed.

An advantageous continuation provides that the basic drum body is coupled with the milling drum drive and supports the end of the milling tube facing the side wall.

A further advantageous continuation of the invention provides that a push-off device engages with the milling tube or with the rotating body, which permits the milling tube to be pulled from its mounted position in the pulling direction for the purpose of disassembly. The push-off device may be provided either mechanically or hydraulically.

Furthermore, it is provided in a particularly advantageous manner that the supporting surfaces with different supporting circle diameters, arranged behind one another axially, show a chamfer of, for instance, less than 45° at the junctions of the individual steps. This chamfer allows the milling tube to be centred more easily during assembly, thus facilitating the assembly. Preferably, a chamfer of less than 45° is used.

In the following, embodiments of the invention are explained in more detail with reference to the drawings. The following is shown:

DESCRIPTION OF THE PREFERRED EMBODIMENTS

Figure 1:
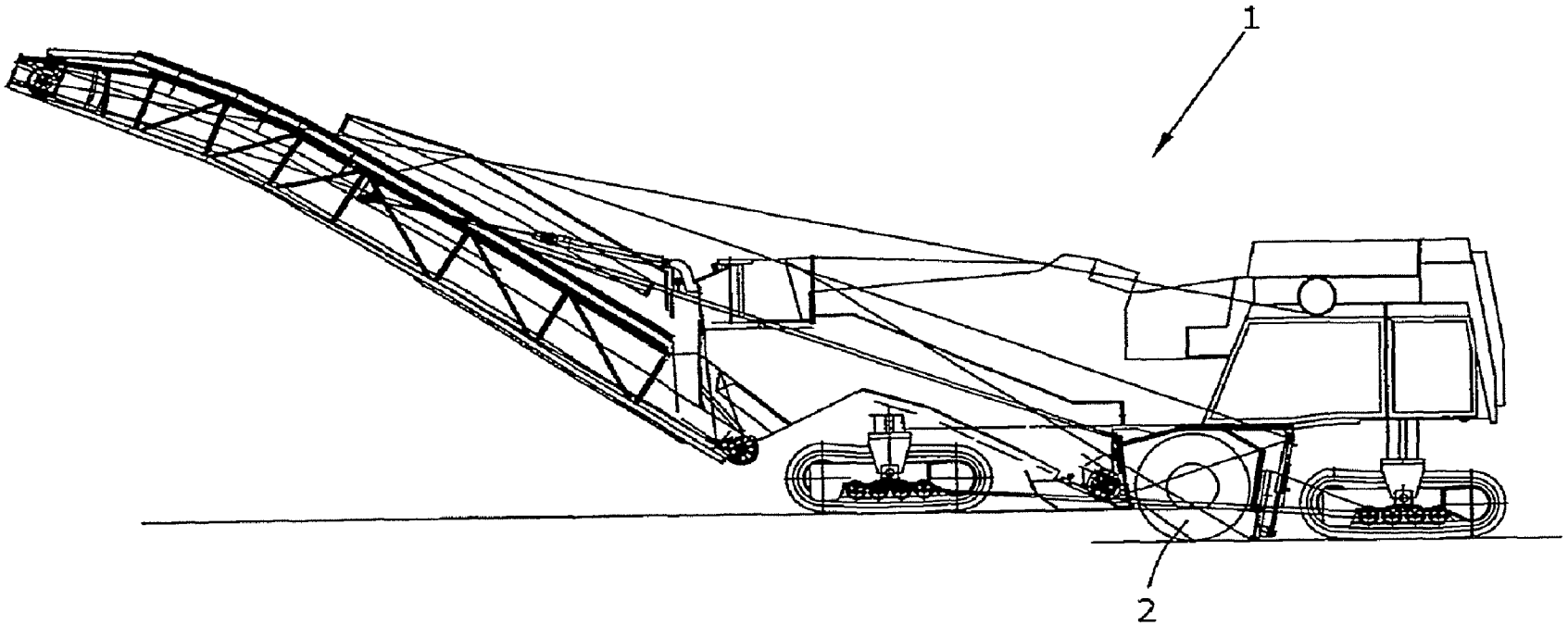
FIG. 1 a road construction machine.

FIG. 1 depicts a road construction machine 1 in which a quick-change system for milling tubes can be used.

The road construction machine is a road milling machine which commonly has a machine frame, with a combustion engine and operator's platform being mounted on said machine frame. The automotive road construction machine has height-adjustable lifting columns attached to the machine frame, with support wheels or crawler track units being mounted at the said lifting columns.

The milling drum 2 is located below the machine frame in a drum housing 9 that displays the side walls 13, 15 at the sides. The reference mark 7 indicates the cutting outline of the tools located on the milling drum 2. The material processed by the milling drum 2 is discharged on a first loading conveyor or is transported further onto a second, height-adjustable and slewable loading conveyor in a basically known manner.

Figure 2:
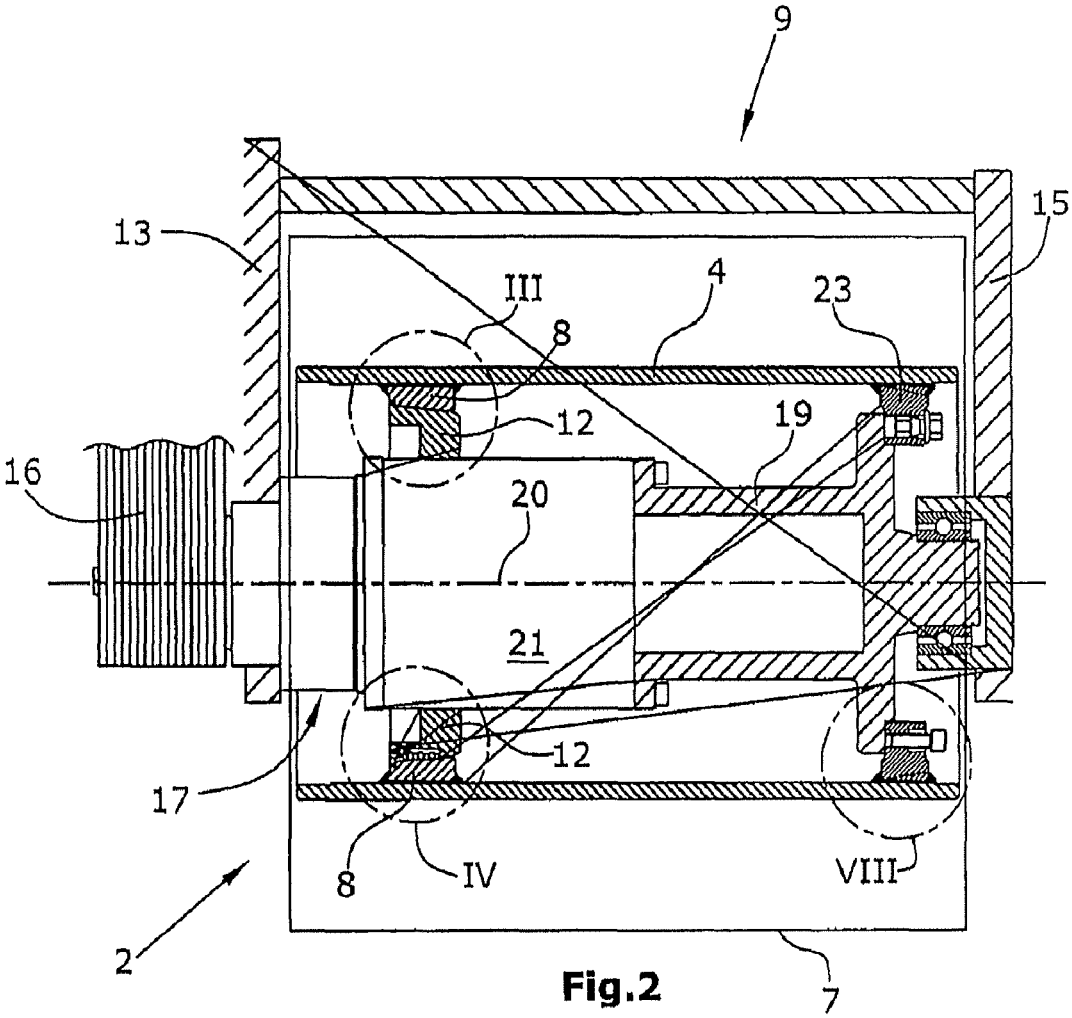
FIG. 2 a milling drum mounted on both sides.

In FIG. 2, a milling drum 2 is mounted in a rotatable manner between side walls 13, 15 of the drum housing 9, where the said side walls 13, 15 are arranged orthogonal to the axis 20 of the milling drum 2, and where the said milling drum 2 is driven via a driving device 16, mounted at the side wall 13 on the drive side, and a gearbox unit 17. The milling drum 2 depicted in FIG. 2 comprises an integral milling tube 4, which is attached to a basic drum body 19 in an interchangeable manner. The basic drum body 19 is in turn attached to the output housing 21 of the gearbox unit 17. The basic drum body 19 is arranged axially at the side of the output housing 21, transferring the torque of the gearbox unit 17 to the particular milling tube 4 inserted in the manner of a reduction gear.

The milling drum drive 16 preferably comprises a belt drive.

In FIG. 2, the milling tube 4 is bolted to the basic drum body 19 by way of an annular flange 23 which is in turn mounted in the removable side wall 15 in a rotatable manner. A support ring 8 is arranged on the side of the milling tube 4 facing the milling drum drive 16, where the said support ring 8 is connected to the milling tube 4 in a non-rotatable manner and co-operates with a support ring mount 12 sitting on top of the output housing 21.

The support ring 8 and the support ring mount 12 display several complementary supporting surfaces 22, 24 arranged concentrically to the axis 20 of the milling drum, where the said supporting surfaces 22, 24 have different supporting circle diameters and are arranged behind one another axially with their diameter decreasing incrementally in the direction of the side wall 15. In the embodiments, five supporting surfaces, for instance, are arranged behind one another axially. In the embodiments presented, the axial length of the supporting surfaces 22, 24 is 15 mm. It can vary, however, depending upon the diameter of the milling drum 2, between 5 and 40 mm and preferably between 10 and 20 mm.

The embodiments show that all supporting surfaces 22, 24 are of the same length axially. They may, however, also have different lengths, and preferably in such a manner that the length of the supporting surfaces 22, 24 decreases in accordance with the decreasing supporting circle diameter.

Figure 3:
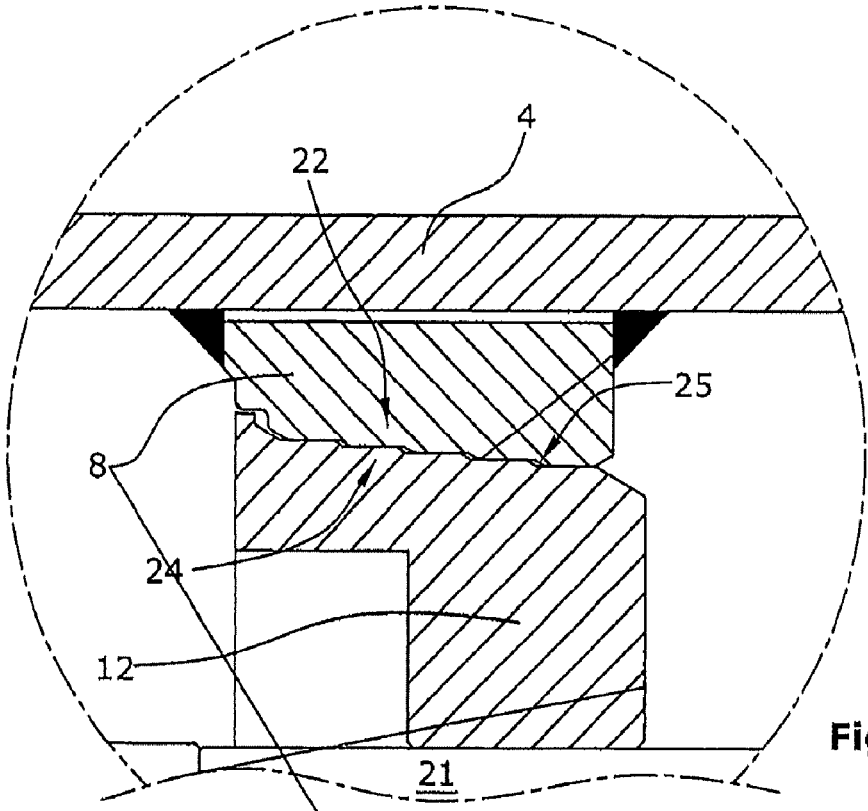
FIG. 3 the supporting surfaces of the support ring and the support ring mount, lying on top of each other, in accordance with detail III in FIG. 2.
Figure 4:
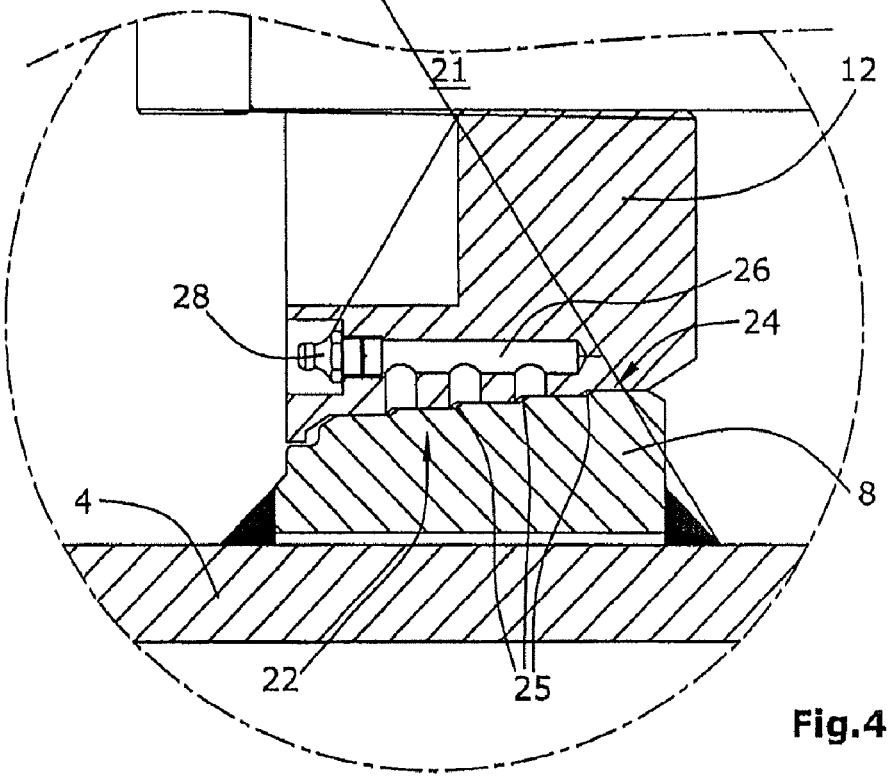
FIG. 4 an alternative embodiment of a support ring mount with grease lubrication.

As can best be seen from FIGS. 3 and 4, the supporting surfaces 22 of the support ring 8 are offset axially in relation to the supporting surfaces 24 of the support ring mount 12 when seen in the direction of the side wall 15, and in such a manner that annular chambers 25 are formed at the junctions of the individual steps. The annular chambers 25 may be filled with an anti-corrosive agent and/or a lubricant. As can be seen from FIG. 4, an injection duct 26 may be provided where, as can be seen from FIG. 3, the said injection duct 26 may be used to supply at least three annular chambers 25 with, for instance, grease via a grease nipple 28.

The supporting surfaces 22, 24 may be coated with a gliding layer to facilitate the assembly and disassembly of the milling tube 4.

Figure 9:
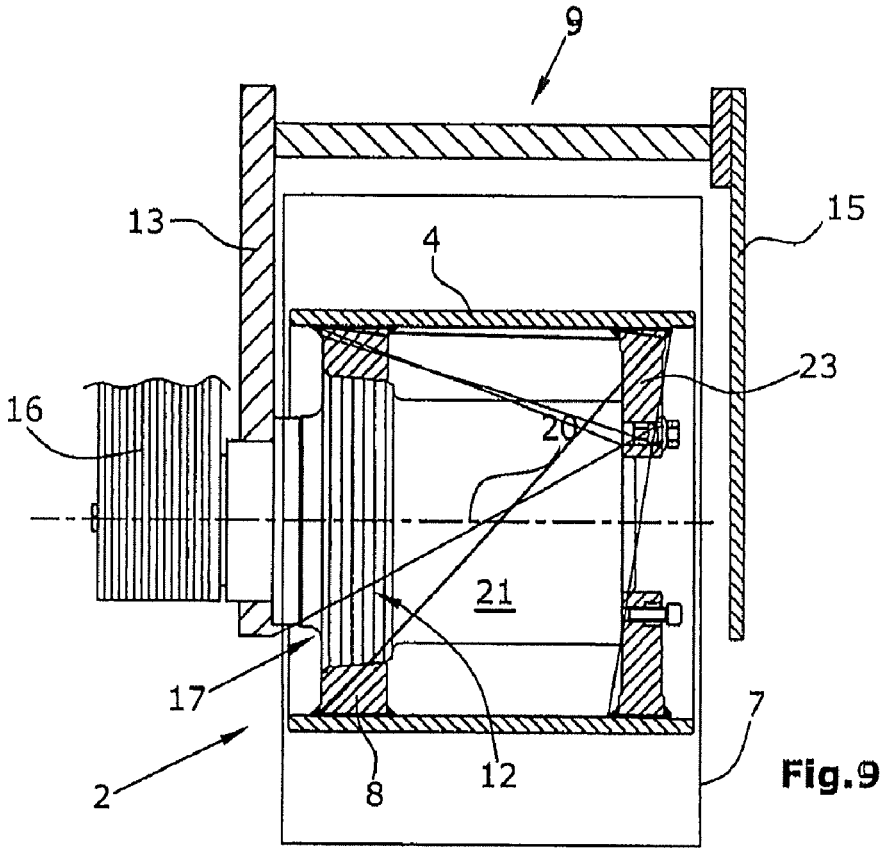
FIG. 9 a further embodiment for mounting a milling tube.
Figure 10:
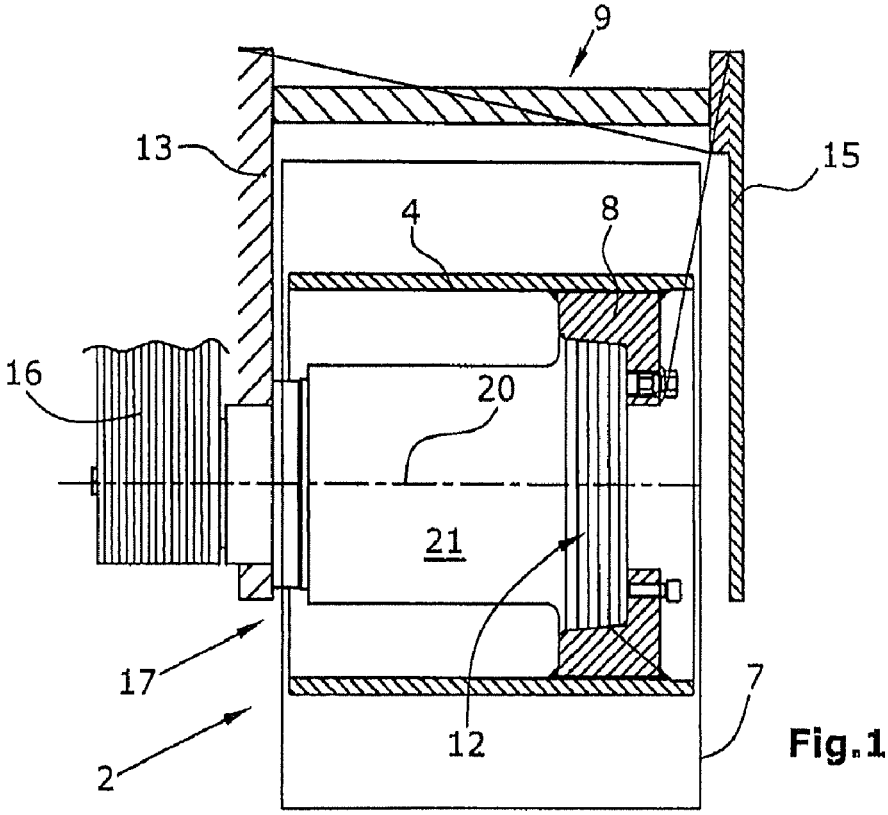
FIG. 10 an embodiment for a one-sided mounting or floating mounting respectively of the milling tube.

The support ring mount 12 may comprise a single-part ring, as can be seen from FIG. 2, or else may be integral with the output housing 21 of the gearbox unit 17, as is shown in the embodiments of FIGS. 9 and 10.

Figure 5:
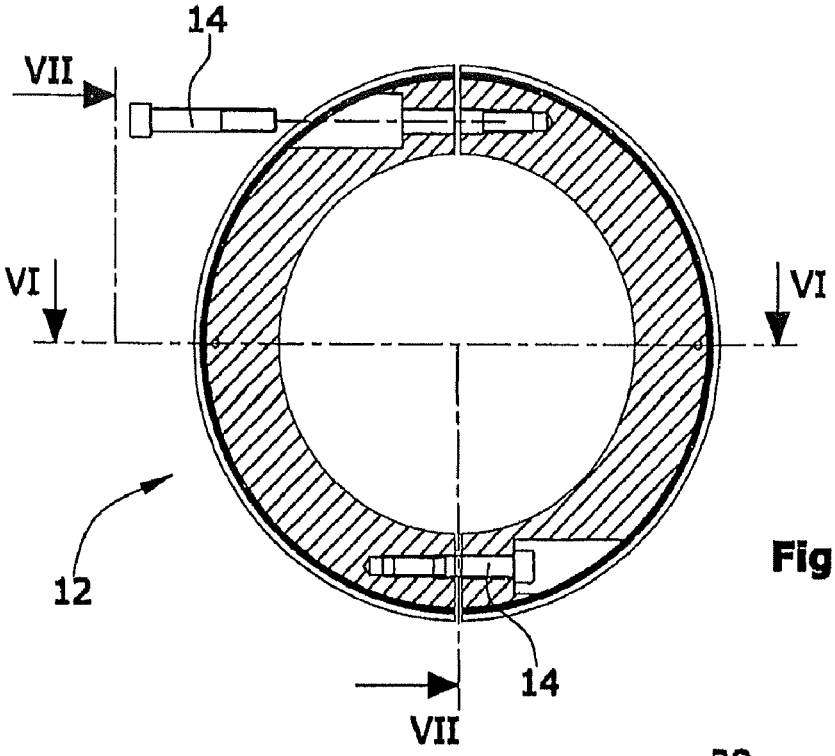
FIG. 5 a two-part support ring mount.
Figure 6:
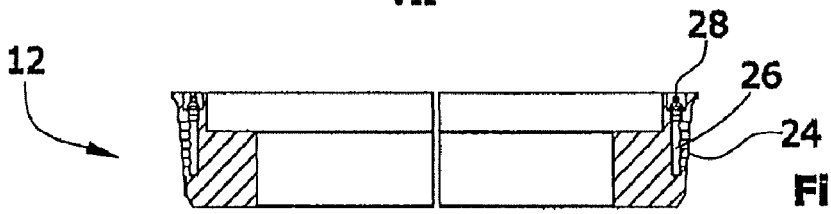
FIG. 6 a section along the line VI-VI in FIG. 5.
Figure 8:
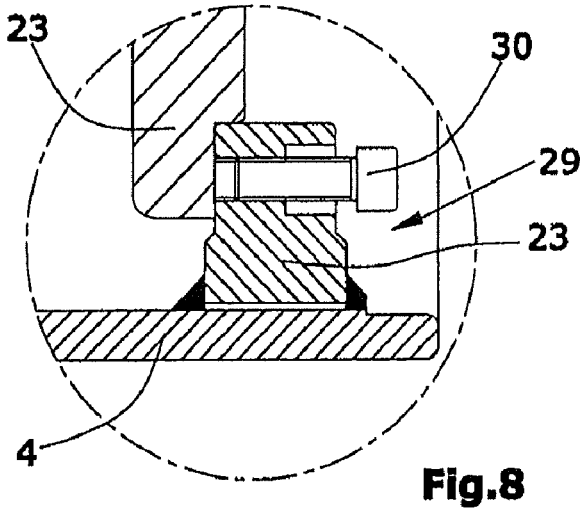
FIG. 8 a push-off device in accordance with the enlarged detail VIII in FIG. 2.

As can be seen from FIGS. 5 and 6, the support ring mount 12 may alternatively comprise a multi-part, in FIGS. 5 and 6 two-part, ring that is suitable for being mounted on a rotating body, such as, for instance, the output housing 21 of the gearbox unit 17.

The support ring mount 12 may also be mounted on a rotating body in a movable manner axially, as is possible in the embodiments in FIGS. 2 to 4, or may be mounted on the rotating body in an immovable manner axially, as can be seen from the embodiments in FIGS. 9 and 10.

Mounting bolts 14 can be seen in FIG. 5, by means of which the support ring mount 12 can be mounted on a rotating body. It is understood that the rotating body may also comprise an annular flange or connecting flange and need not necessarily be an output housing 21 or a basic drum body 19.

FIG. 6 is a section along the line VI-VI in FIG. 5, wherein the section runs through the injection duct 26.

Figure 7:
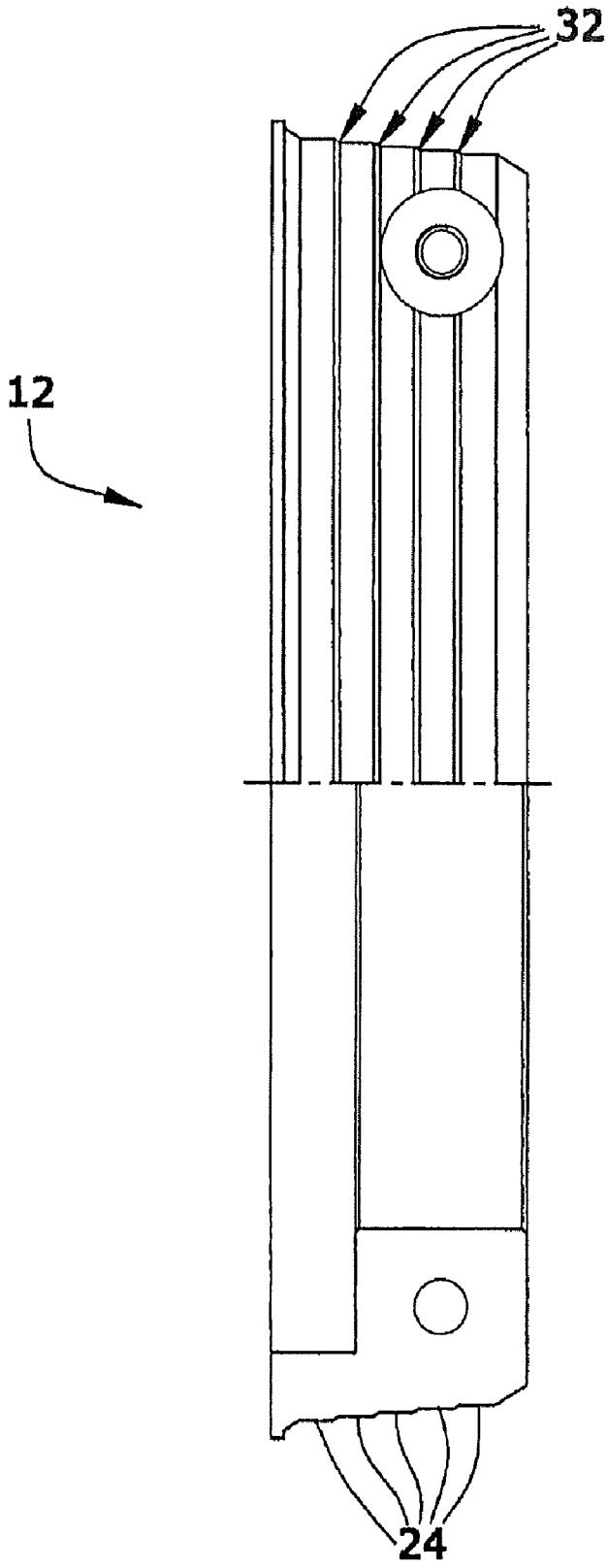
FIG. 7 a half-section of the support ring in the direction of the arrows VII in FIG. 5.

FIG. 7 shows a side view of the support ring mount 12 along the line VII-VII in FIG. 5.

A mechanical push-off device 29 is shown in FIG. 7, which allows the milling tube 4 to be pulled from its mounted position on the support ring mount 12 by means of bolts 30.

To do this, the bolts 30 are screwed against the mounting flange 23, which allows the milling tube 4 of the milling drum 2 to be pulled.

It can also be seen from FIG. 7 that one chamfer 32 each of less than 45° is provided between the supporting surfaces 24 of the support ring mount 12 at the junctions of the individual steps, which facilitates assembling and centering of the milling tube 4. Corresponding chamfers 32 are also provided between the supporting surfaces 22 of the support ring 8.

The supporting surfaces 22, 24 are arranged concentrically, preferably coaxially, to the axis 20 of the milling drum. One step between the supporting surfaces 22, 24 has a height of, for instance, 1 to 4 mm, with an increment between steps of 2 mm having turned out to be of particular advantage.

What is claimed is:

1. A construction machine, comprising:

a milling drum;

a milling drum drive;

a rotatable body operably attached to the milling drum drive;

a support ring connected to the milling drum and including a plurality of axially consecutive support ring surfaces, each consecutive support ring surface including a smaller support ring surface diameter than the previous support ring surface; and a support ring mount attached to the rotatable body and engaging the support ring, the support ring mount including a plurality of axially consecutive support ring mount surfaces, each one of the plurality of support ring mount surfaces being complementary to a corresponding one of the plurality of support ring surfaces so that the support ring can be axially separated from the support ring mount.

2. The machine of claim 1, wherein:

the support ring mount is detachably securable to the rotatable body.

3. The machine of claim 1, wherein:

the support ring mount is interchangeably securable to the rotatable body at multiple axial locations.

4. The machine of claim 1, wherein the support ring mount is integrally formed on the rotatable body.

5. The machine of claim 1, further comprising:

a gearbox disposed between the milling drum drive and the rotatable body, the gearbox including an output portion.

6. The machine of claim 5, wherein:

the support ring mount is attached to the output portion.

7. The machine of claim 1, wherein:

the milling drum is interchangeably securable to the rotatable body using a mechanical fastener.

8. The machine of claim 1, wherein:

two consecutive adjacent support ring surfaces of the plurality of axially consecutive support ring surfaces are separated by a first chamfer having a first chamfer angle less than about 45 degrees.

9. The machine of claim 8, wherein:

two consecutive adjacent support ring mount surfaces of the plurality of axially consecutive support ring mount surfaces are separated by a second chamfer complementary to the first chamfer, the second chamfer having a second chamfer angle less than about 45 degrees.

10. A method of positioning a milling drum relative to a construction machine, the method comprising the steps of:

(a) providing a milling drum including a support ring having at least first and second axially consecutive support ring surfaces with successively decreasing support ring surface diameters;

(b) providing a milling drum drive including a support ring mount, the support ring mount including at least first and second support ring mount surfaces complementary to the at least first and second support ring surfaces, respectively, so that the at least first and second support ring mount surfaces can be received within the at least first and second support ring surfaces; and (c) installing the milling drum with support ring axially onto the support ring mount so that the first support ring surface engages the first support ring mount surface and so that the second support ring surface engages the second support ring mount surface.

11. The method of claim 10, further comprising:

securing the milling drum to the milling drum drive.

12. The method of claim 10, wherein the support ring mount includes an axial support ring mount length L, and each support ring mount surface has an axial support ring mount surface length less than L, the method further comprising:

disengaging the support ring from the support ring mount by pulling the milling drum axially away from the support ring mount an axial distance less than L.

13. The method of claim 12, further comprising:

removing the milling drum from the milling drum drive by pulling the milling drum generally away from the milling drum drive a distance greater than L.

14. The method of claim 10, wherein the support ring mount includes an axial support ring mount length L, and each support ring mount surface has an axial support ring mount surface length less than L, wherein the number of axially consecutive support ring mount surfaces is equal to an integer N, the method further comprising:

disengaging the support ring from the support ring mount by pulling the milling drum axially away from the support ring mount an axial distance no greater than L divided by N.

15. The method of claim 14, further comprising:

removing the milling drum from the milling drum drive by pulling the milling drum generally away from the milling drum drive a distance greater than L.

16. The method of claim 10 further comprising:

forming an annular chamber between a support ring surface and a complementary support ring mount surface, wherein the support ring surface and the complementary support ring mount surface are axially offset.

17. A method of supporting a milling drum from a milling drum drive of a construction machine, the method comprising:

supporting the milling drum from the milling drum drive via a stepped support ring on the milling drum including at least two adjacent support ring surfaces of different diameters received upon complementary support ring mount surfaces attached to the milling drum drive.

18. The method of claim 17, further comprising:

engaging at least one support ring surface with a complementary support ring mount surface by axially pushing the milling drum toward the support ring mount surfaces.

19. The method of claim 17, further comprising:

axially disengaging at least one support ring surface from a complementary support ring mount surface by pulling the milling drum axially away from the support ring mount surfaces.

20. The method of claim 17, wherein at least two support ring surfaces have different axial lengths, further comprising:

initiating engagement of at least two support ring surfaces with complementary support ring mount surfaces nonsimultaneously.

21. The method of claim 17, further comprising:

forming an annular chamber between a support ring surface and a complementary support ring mount surface, wherein the support ring surface and the complementary support ring mount surface are axially offset.

22. The method of claim 21, further comprising:

lubricating the stepped support ring by introducing a lubricant into the annular chamber.

23. The method of claim 17, further comprising:

removing the milling drum from the construction machine by axially pulling the milling drum away from the milling drum drive and disengaging each support ring surface from a complementary support ring mount surface; and positioning a replacement milling drum on the construction machine.

* * * * *